US007367280B1

(12) United States Patent
Armstrong

(10) Patent No.: US 7,367,280 B1
(45) Date of Patent: May 6, 2008

(54) BOOKMARK

(76) Inventor: Lafayette Armstrong, 1617 Latrobe St., Baltimore, MD (US) 21202

( * ) Notice: Subject to any disclaimer, the term of this patent is extended or adjusted under 35 U.S.C. 154(b) by 0 days.

(21) Appl. No.: 11/301,829

(22) Filed: Dec. 12, 2005

(51) Int. Cl.
*B42D 9/00* (2006.01)
*B43K 8/06* (2006.01)

(52) U.S. Cl. ..... 116/234; 116/237; 401/198; 401/195; 401/131

(58) Field of Classification Search ..... 116/234, 116/238, 239, 235, 236, 237, 240; D19/34, D19/36; 401/198, 199, 195, 202, 131
See application file for complete search history.

(56) References Cited

U.S. PATENT DOCUMENTS 4,732,504 A * 3/1988 Telli ..... 401/209
4,795,156 A * 1/1989 Paulish ..... 273/148 R
4,934,304 A * 6/1990 Rosen ..... 116/237
5,017,034 A * 5/1991 Stary et al. ..... 401/35
D322,811 S * 12/1991 Isern ..... D19/36
5,308,178 A * 5/1994 Jiang ..... 401/8
5,632,564 A * 5/1997 Chu ..... 401/104
5,678,939 A * 10/1997 Ross ..... 401/6
5,984,558 A 11/1999 Diep ..... 401/195
6,006,693 A 12/1999 Burkett ..... 116/234
D452,270 S 12/2001 Mershon ..... D19/36
6,572,297 B2 * 6/2003 Korper ..... 401/186
6,659,672 B1 * 12/2003 Kirita ..... 401/199
6,895,888 B1 * 5/2005 Spillman ..... 116/238
7,264,141 B2 * 9/2007 Patel et al. ..... 222/214
2003/0143014 A1 * 7/2003 Steinschaden ..... 401/48
2005/0254881 A1 * 11/2005 Zhang ..... 401/131
2006/0257198 A1 * 11/2006 Roeloffs ..... 401/131

* cited by examiner

*Primary Examiner*—Richard Smith
*Assistant Examiner*—Amy Cohen Johnson
(74) *Attorney, Agent, or Firm*—Lawrence E. Laubscher, Sr.; Lawrence E. Laubscher, Jr.

(57) ABSTRACT

A household apparatus that combines the function of a bookmark and a highlighter/marker is provided. The apparatus has enclosed an inkwell that includes a volume of ink. The apparatus has thin shape that allows it to serve as a bookmark, while at the same time, has a marker portion that is covered by a cover when it is not in use.

2 Claims, 2 Drawing Sheets

BOOKMARK

BACKGROUND OF THE INVENTION

1. Field of the Invention

This invention relates generally to a bookmark and, more particularly, the invention relates to a bookmark combined with a highlighter/marker.

2. Description of the Prior Art

U.S. Pat. No. 6,006,693, issued to Burkett, discloses a bookmark that is combined with a highlighter pen to provide convenience while reading.

U.S. Pat. No. 5,984,558, issued to Diep, discloses a bookmark that is combined with a highlighter pen to provide convenience while reading.

U.S. Pat. No. D452,270, issued to Mershon, discloses an ornamental design for a combination pen and bookmark device.

SUMMARY

The present invention is that of a household apparatus that combines the function of a bookmark and a highlighter/marker. The apparatus has enclosed an inkwell that includes a volume of ink. The apparatus has thin shape that allows it to serve as a bookmark, while at the same time, has a marker portion that is covered by a cover when it is not in use.

There has thus been outlined, rather broadly, the more important features of a household apparatus that the detailed description thereof that follows may be better understood and in order that the present contribution to the art may be better appreciated. There are, of course, additional features of the household apparatus that will be described hereinafter and which will form the subject matter of the claims appended hereto.

In this respect, before explaining at least one embodiment of the household apparatus in detail, it is to be understood that the household apparatus is not limited in its application to the details of construction and to the arrangements of the components set forth in the following description or illustrated in the drawings. The household apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present household apparatus. It is important, therefore, that the claims be regarded as including such equivalent constructions insofar as they do not depart from the spirit and scope of the present invention.

It is therefore an object of the present invention to provide a household apparatus which has all of the advantages of the prior art and none of the disadvantages.

It is another object of the present invention to provide a household apparatus which may be easily and efficiently manufactured and marketed.

It is another object of the present invention to provide a household apparatus which is of durable and reliable construction.

It is yet another object of the present invention to provide a household apparatus which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
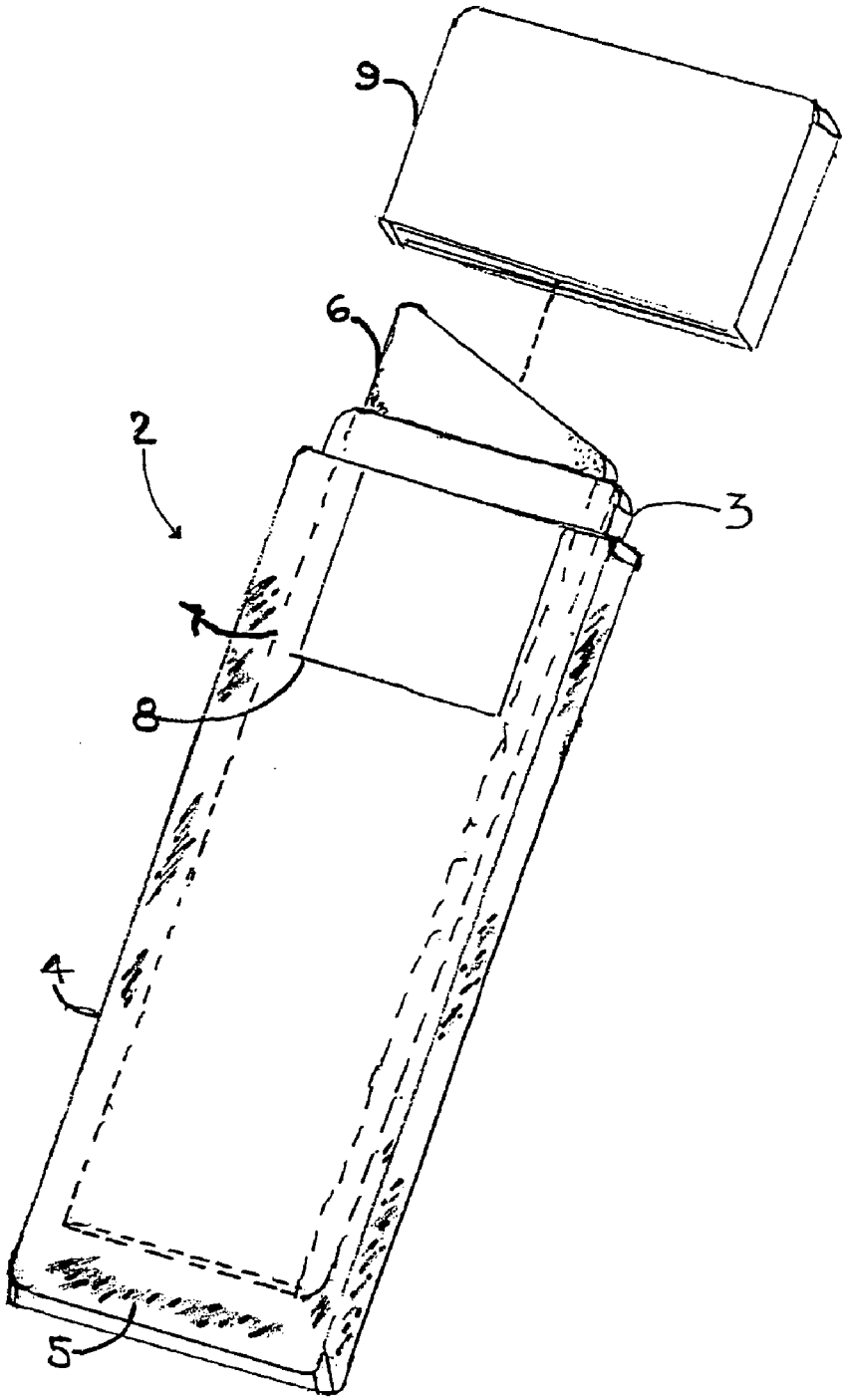
FIG. 1 is a perspective view illustrating a bookmark, constructed in accordance with the present invention.

FIG. 1 shows a perspective view of the apparatus 2. The apparatus 2 is designed to be a household apparatus that serves both as a bookmark for a book 14 and a highlighter/marker, depending on the time it is being used.

The apparatus 2 includes a marker assembly housing 3 having a marker end and a handle end 7. Preferably, the handle end 7 is substantially rigid. An inkwell 4 for holding ink 5 or the like within the housing completes the apparatus 2. In sum, the apparatus 2 consists of the housing for holding a volume of absorbent material or chisel tip 6 in liquid communication with the ink within the inkwell, and the handle end 7 of the marker assembly 3. A paper clip assembly 8 is formed on the outer surface of the housing. The paper clip assembly 8 is designed for positioning about a page or pages within the book 14.

The thickness of handle end 7 is preferably approximately 1/32 inch, however having a thickness greater than approximately 1/32 inch or less than approximately 1/32 inch is within the scope of the present invention. However, since the apparatus 2 is designed to serve as a bookmark as one of its functions, it is preferable that the thickness of the apparatus 2 is no more than a few millimeters thick, or else, it will not maintain its position within the book 14 when placed within the book 14 as a bookmark.

The handle end 7, denoted by hidden lines in FIG. 1, will be the handle end of the marker assembly 3 and is part of a single piece or mold along with the paper clip 8. Absorbent material 6 has two ends, an exposed and an inner end, with the inner end being inserted far enough so that it is in contact with the volume of ink 5 within the inkwell 4. The exposed end of the absorbent material 6 is located outside of the marker assembly 3, and would be placed in contact with a paper surface for use as a marker. Some of the ink of the volume ink 5 within the inkwell 4 will enter the absorbent material 6 through the inner end of the absorbent material 6, and will migrate over to the expose end of the absorbent material 6, allowing some of this ink to be deposited whatever surface the absorbent material 6 is placed into a contact with.

The inkwell 4 preferably consists of a pliable plastic material similar to the material used for carryout condiment packaging. The inkwell 4 is attached to the bottom hollow perimeter of the marker assembly 3. The inkwell 4 surrounds and encloses the handle end 7 of the marker assembly 3 and includes the volume of incorporated ink 5. The handle end is attached to the inside of the marker assembly 3 and the paper clip assembly 8 is an extension of the front bottom edge of the marker assembly 3.

A cover 9, shown in FIG. 1 as not being connected to the marker end of marker assembly 3, is positionable over both absorbent material 6 and the exposed portion of the marker assembly 3 when the highlighter/marker function of apparatus 2 is not being used. The cover 9 is ideally used to prevent the absorbent material 6 from drying out, as the absorbent material 6 is always exposed to some of the ink 5 within the inkwell 4.

Figure 2:
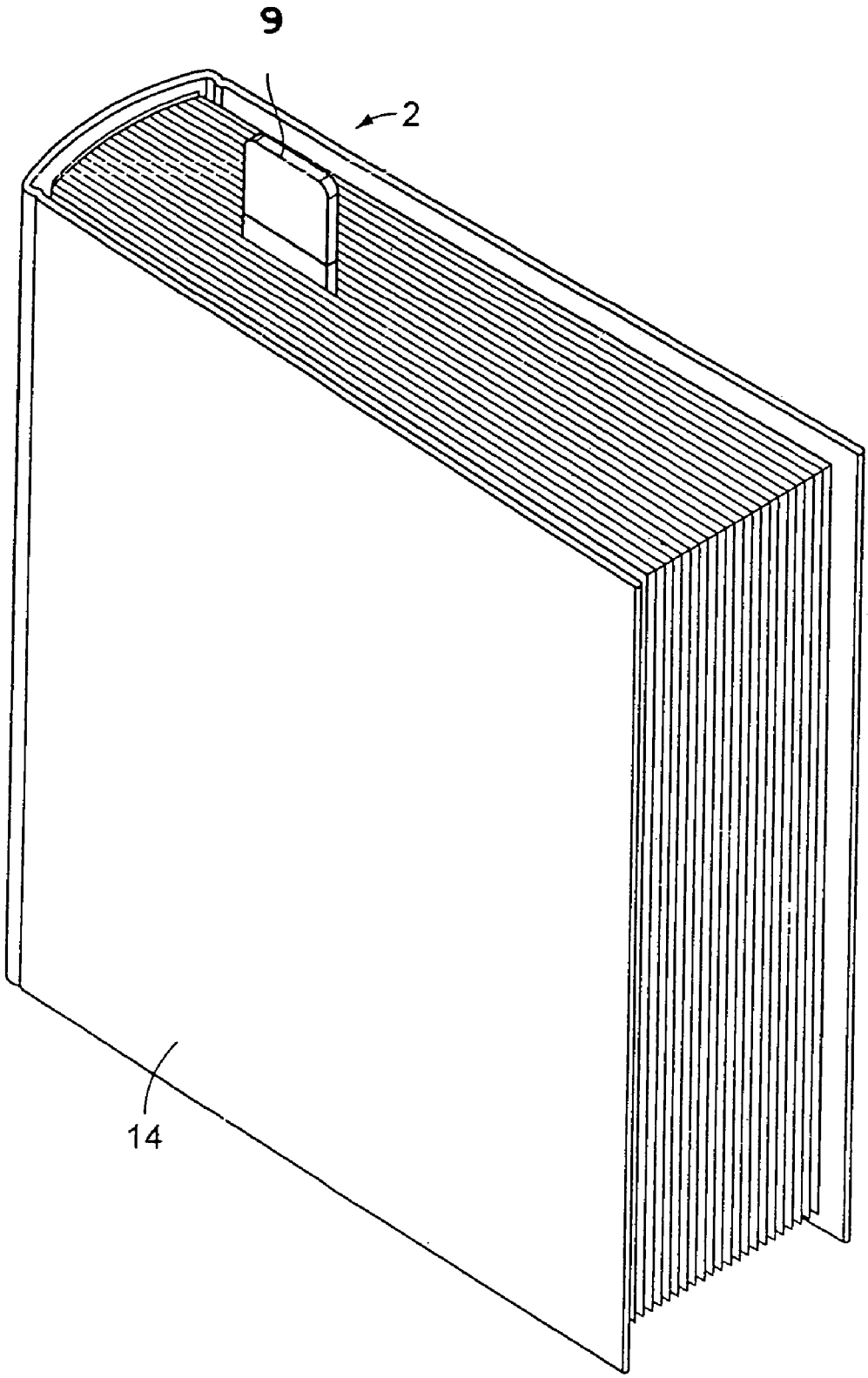
FIG. 2 is a perspective view illustrating the bookmark, constructed in accordance with the present invention, as it would appear in use as a bookmark in a book.

FIG. 2 shows a perspective view of the present invention as would appear in use as a bookmark. The cover 9 has been placed over the absorbent material 6 and the exposed portion of the marker assembly 3. Although the marker end of the marker assembly 3 is shown as the end sticking out of the book 14 in FIG. 2, the handle end could just as well be the end that is exposed outside of the book 14.

The foregoing exemplary descriptions and the illustrate preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A marker assembly for books, comprising:

(a) a rectangular flat receptacle (4) containing an ink chamber for receiving ink, said receptacle being formed from a pliable synthetic plastic material and having an opening at one end communicating with said chamber;

(b) a hollow marker housing (3) containing a through passage, said marker housing having a first end portion mounted in said receptacle opening, and a second end portion extending outwardly from said receptacle opening;

(c) a marker body formed from an absorbent material, said marker body being mounted in said housing through passage and having a first handle end portion (7) extending into said chamber, an intermediate portion arranged in said marker housing through passage, and a second writing end portion (6) extending outwardly from said marker housing, said writing end portion being contoured to define a writing tip;

(d) a cover member (9) having an end portion containing a recess receiving said marker body writing end portion, said cover member end portion being removably mounted concentrically about said marker housing second end portion; and (c) clip means (8) connected with said marker housing for fastening the marker assembly upon a page of a book, said clip means including a clip member fastened at one end with said marker housing second end, the other end of said clip member extending over said receptacle.

2. A marker assembly as defined in claim 1, wherein said marker body handle end portion (7) has a thickness of about 1/32 inch; and further wherein said receptacle is of the condiment-receiving type having a thickness of about a few millimeters, whereby said receptacle serves as a bookmark when the marker device is clipped to the page of a book.

* * * * *